United States Patent [19]

Gruber

[11] Patent Number: 4,662,017

[45] Date of Patent: May 5, 1987

[54] METHOD AND APPARATUS FOR PRODUCING FOOTWEAR

[75] Inventor: Ernst Gruber, Pirmasens, Fed. Rep. of Germany

[73] Assignee: Ferd. Schäfer & Söhne GmbH & Co. KG, Pirmasens, Fed. Rep. of Germany

[21] Appl. No.: 787,989

[22] Filed: Oct. 16, 1985

[30] Foreign Application Priority Data

Oct. 17, 1984 [DE] Fed. Rep. of Germany ..... 3437928

[51] Int. Cl.[4] ..... A43B 9/12; A43B 13/32; A43D 3/08; A43D 25/10

[52] U.S. Cl. ..... 12/142 F; 12/142 T; 12/124; 12/33; 36/14; 36/19.5

[58] Field of Search ..... 36/12, 13, 14, 19.5; 12/142 RS, 142 T, 142 F, 8.1, 33, 133 R, 124, 33.2

[56] References Cited

U.S. PATENT DOCUMENTS

| | | | |
|---|---|---|---|
| 1,236,462 | 4/1918 | Payne | 12/33 R |
| 1,822,039 | 9/1931 | Kinney | 12/8.1 |
| 1,825,276 | 9/1931 | L'Hollier | 12/133 R |
| 2,486,995 | 11/1949 | Steed | 12/142 RS |
| 2,644,179 | 7/1953 | Kleven | 36/19.5 |
| 3,116,501 | 1/1964 | Markevitch | 36/14 |
| 4,073,023 | 2/1978 | Liebscher et al. | 12/142 RS |
| 4,266,314 | 5/1981 | Londner Epouse Ours | 36/14 |

FOREIGN PATENT DOCUMENTS

| | | | |
|---|---|---|---|
| 1510005 | 7/1969 | Fed. Rep. of Germany . | |
| 2302435 | 7/1973 | Fed. Rep. of Germany . | |
| 2306129 | 8/1974 | Fed. Rep. of Germany . | |
| 2342304 | 3/1975 | Fed. Rep. of Germany . | |
| 2360249 | 6/1975 | Fed. Rep. of Germany . | |
| 2618183 | 11/1977 | Fed. Rep. of Germany . | |
| 501770 | 11/1954 | Italy | 36/14 |
| 200700 | 7/1933 | United Kingdom | 12/124 |
| 763233 | 12/1956 | United Kingdom | 12/142 RS |
| 931147 | 6/1982 | U.S.S.R. | 12/124 |

*Primary Examiner*—Werner H. Schroeder
*Assistant Examiner*—Steven N. Meyers
*Attorney, Agent, or Firm*—Toren, McGeady and Goldberg

[57] ABSTRACT

In a method for producing footwear, wherein the shaft and the shell sole of the footwear are glued together, the leather upper part of the footwear is first cut to size without the formation of a lasting fold, it is prepared and then roughened along a lower border thereof. After shaping of the tip, so as to conform to the last, the preformed shaft is stretched to measure, and a rear cap is simultaneously molded in. The shell sole, which is likewise glued, is placed on a glued border and pressed against at least the tip and heel and is also possibly sewn with a seam, after which a cover sole is placed and the shoe or footwear is completed.

7 Claims, 6 Drawing Figures

METHOD AND APPARATUS FOR PRODUCING FOOTWEAR

The present invention is directed to a method and apparatus for producing footwear and more particularly to a method wherein the leather upper part or vamp is, without formation of a lasting fold, first cut to size, then prepared and sewn to the shaft and provided with a front cap or toe portion and with a rear cap or heel portion, the lower border of the shaft and the border of a shell sole being then roughened. In the type of method to which the invention relates, the parts of the shaft and shell sole to be cemented together are then glued, and, finally, the shell sole is placed upon and pressed against at least the tip and heel.

In the manufacture of shoes comprising shell soles, there are presently involved approximately 17 work operations. First, the insole must be basted or stitched and then a rear cap is molded or shaped in and the last is assigned and the tip is lasted. After activating, the sides and finally the heel are lasted. In separate work operations, the base and the sides must be roughened, and then the base and the sides are glued. The glue must now be activated and the shell sole put in place. Subsequently, the gluing surfaces are pressed and dried, and, finally, the last is removed from the shoe, the cuts are cleaned and the shoe is provided with a finish and the cover sole is placed in.

In methods of the type discussed above, with a plurality of work operations, the cost of labor and the production costs tend to be high. A further disadvantage of the typical shoe production is the relatively high portion of leather which must be used for the lasting fold, which requires approximately 30% of the leather upper. However, the demand for leather has increased and it will be found that higher demands exist not only in the shoe industry, but also in automobile construction and in the manufacture of upholstered furniture, where the best leather tends to be used to an increasing degree. However, the production of raw hides has not increased in equal measure, and, thus, there is a considerable demand for utilization of production methods in the manufacture of shoes, wherein the lasting fold may be dispensed with.

There have been attempts in the past to produce shoes without lasting folds. For example, in the prior art, DE-OS No. 23 60 249 discloses a method, wherein the sole is injection molded or sprayed directly onto the leather upper. The shaft is first completely formed before the injection molding of the sole and the shaft is next placed on a forming last acting as an upper part of an injection or spray mold, it is fixed by means of holding clamps and is tightly inserted in a sole mold or form constructed as the lower part of the injection mold. In order to anchor the shaft in the sole, a shaft border corresponding to the lasting border is required and, as a result, the desired economy with regard to the amount of leather utilized is not achieved. Moreover, the production of the sole requires a so-called injection last which is usually not divided, and thus, cannot be used for stretching the shaft to size. Shoes without heels or so-called clogs can also be produced according to this known method.

Another attempt to produce shoes without insoles is disclosed in the prior art in DE-AS No. 23 42 304. this case, the tip area is formed by correspondingly cutting the leather to size and by a subsequent sewing operation. The tip of the shoe receives a less attractive configuration in this manner, and, moreover, the shaft must be fixed in the tip and heel area of the last by means of mandrels or arbors. However, these mandrels are obstructive when the last must be removed, since they can possibly damage the lining and also the leather. Additionally, the specific injection molding operates to limit the constructive freedom of the patternmaker.

In accordance with DE-OS No. 26 18 183, the leather upper must be glued on and possibly also subjected to a sewing operation at a raised shaft border of the sole. However, there is provided no disclosure for fastening the substantially flat leather of the half-sole or boot, specifically in the area of the shoe tip at the outsole. The method disclosed in this prior art is therefore best suited for producing belt sandals.

DE-OS No. 23 06 129 discloses a method and apparatus for the preliminary formation of the complete shoe shaft. In the case of this prior art, the rear cap is definitively formed on a two-piece adjustable or compression or press mold, but the front cap is only formed in a preliminary manner, so that it connects with the leather and may be prepared for the subsequent lasting operation.

In the prior art, a tip shaping machine is known from DE-OS No. 2 302 435, which device is common in the shoe industry, but does not form part of the present invention.

Accordingly, in view of the prior art, the present invention is directed toward providing a method for producing footwear of the aforementioned type which operates without a lasting fold and without lasting processes, wherein the remaining work operations may, to a great extent, be mechanically performed and partially automatically, and wherein the completed shoe does not differ either in appearance or durability from conventional shoes made by prior art or conventional techniques.

SUMMARY OF THE INVENTION

Accordingly, the method of the present invention is directed toward producing footwear, wherein the leather upper, devoid of a lasting fold, is first cut to size, prepared, sewed to the shaft and provided with a front cap and a rear cap. The lower border of the shaft and the border of the shell sole are then roughened and the parts of the shaft and the shell sole to be cemented together are glued. Finally, the shell sole is placed on and pressed at least against the tip and the heel. The invention is particularly characterized in that, after the shaft is sewed, only the tip is definitively formed so as to conform to the last. The shaft is then placed on a last-like two-piece tensioning apparatus. It is fixed with contact pressure molds and axially stressed to measure. The rear cap is simultaneously definitively formed and a cover sole is then placed in after the shaft and the shell sole have been glued.

In the apparatus for performing the method of the invention for stretching the shaft to measure, two partial molds are provided which correspond to a last in contour and on which the shaft which is formed in the tip, is placeable. A tip contact pressure mold is provided which secures the shaft in the area of the tip, but leaves the roughened and glued border of the shaft free. A heel contact pressure mold is provided which presses the rear cap, but leaves free the border of the shaft. The partial molds and their respective contact pressure molds are adjustable relative to one another in the longitudinal direction of the sole and additional contact pressure molds are provided for pressing against the border of the shell sole. The partial molds or the contact pressure molds are adapted to be heated.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention

DETAILED DESCRIPTION OF THE PREFERRED EMBODIMENT

Figure 1:
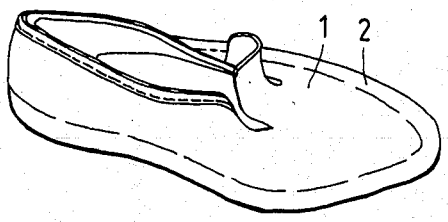
FIG. 1 is a perspective view showing a shaft as it is cut to size in the classic method of shoe production.

Referring first to FIG. 1 of the drawings, there is shown a prepared and stitched shaft 1 at whose lower border there has been provided a lasting fold 2. It will be seen that the surface area of the lasting fold 2 occupies approximately 30% of the entire upper material.

Figure 2:
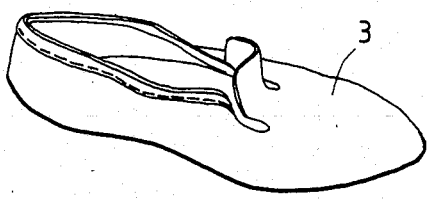
FIG. 2 is a perspective view which shows a shaft as it is cut to size in the method according to the present invention.
Figure 3:
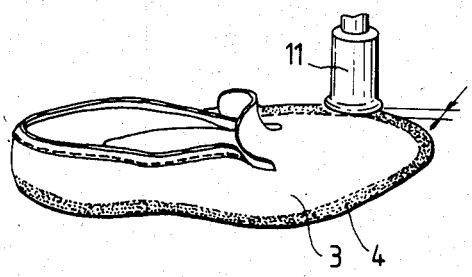
FIG. 3 is a perspective view showing an operation involving roughening of the border of the shaft.

FIG. 2, on the other hand, shows a shaft 3 without a lasting fold, such as is utilized in carrying out the production method in accordance with the present invention. In the method of the present invention, as is shown in FIG. 3, the shaft 3 is processed by roughening in the area of an outer border 4 by means of a leather upper edge roughing machine from which only the roughing or napping tool 11 is shown in FIG. 3. The border 4 may be roughened in a desired width, adapted in each instance to the depth to which the prefabricated shell sole is emersed or dipped.

Figure 4:
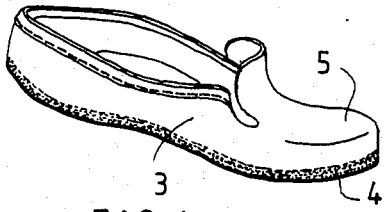
FIG. 4 is a perspective view showing the molding in of the tip of the shaft.

FIG. 4 shows the shaft 3 with the roughened border 4 and with a preformed tip 5. In order to form or shape the tip 5, the sewed shaft must be subjected to an enormously high stretching deformation, particularly when it consists of leather, in order to keep its form in conformance with the last. This occurs even with the inclusion of possible reinforcing caps and the form it subsequently retains is also the form in the state where the last is removed. In conventionally lasted shoes, this occurs primarily during the lasting process by pulling on the lasting fold. However, since the lasting border, and, accordingly, also the lasting process, are dispensed with in the method according to the present invention, the shaft must first be definitively formed in its tip area so as to almost conform to the last before it is connected with the sole. Otherwise, a warping and an unattractive wrinkling or creasing effect might develop.

The operation of preforming the tip is effected in a special tip forming machine which comprises, for example, an uppper, a lower and a middle mold form whose contours correspond to the contour of the last. These molds may be lined with abrasion or wear-resistant material having a certain elasticity thereby making it possible to compensate for different leather thicknesses or strengths.

Figure 5:
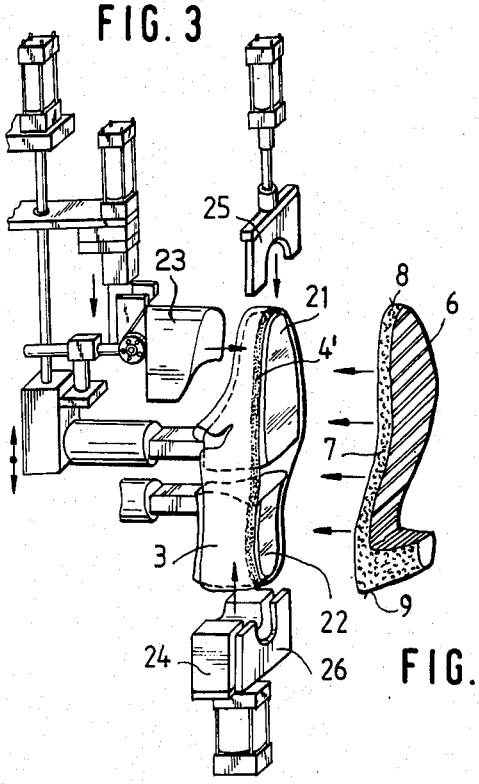
FIG. 5 is an exploded perspective view showing a method and apparatus involving stretching of the shaft to measure and placement of a shell sole.

FIG. 5 depicts the most important method step of the invention and shows in schematic form the apparatus utilized to perform this part of the inventive method. As shown in FIG. 5, the apparatus of the invention comprises a front and a rear partial mold 21, 22 upon which the preformed shaft 3 is placed. The shaft 3 is fixed in the area of its tip at the front partial mold 21 by means of a tip contact pressure mold 23. The two partial molds 21, 22 are then moved apart mechanically and preferably pneumatically, and, in doing so, the shaft is stretched to its final length or size. The contours of the two partial molds 21, 22 correspond to the contours of the completed shoe.

The shaft 3 is pressed against and fixed in the heel area by means of a heel contact pressure mold 24. The rear cap is simultaneously drawn in and pressed. In order to activate the rear cap, the rear partial mold 22 or the contact pressure mold 24 is heated.

The tip and heel contact pressure molds 23, 24 are constructed in such a manner that a glued border 4' of the shaft 3 remains free. The prepared shell sole 6 is placed on this border 4'. Additional contact pressure molds 25 and 26 are now driven forwardly mechanically or pneumatically and press the tip area 8 and the heel area 9 of the shell sole against the partial molds 21, 22. This, accordingly, causes the gluing connection between the shaft 3 and the sole 6 to be effected.

After removing the contact pressure molds 23, 26 and relaxing the partial molds 21, 22, the shoe may be removed from the machine.

Figure 6:
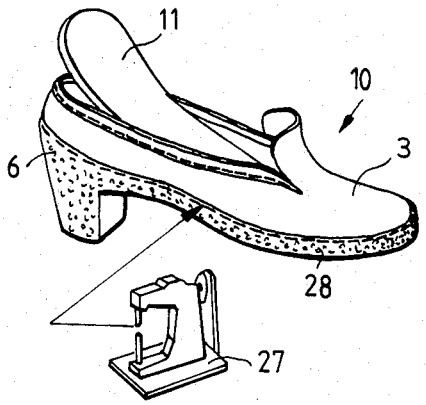
FIG. 6 is a perspective view showing a prepared and sewed shoe including a sewing machine for this purpose.

FIG. 6 shows a shoe 10 consisting of a shell sole 6 and the shaft 3 subsequent to the operations depicted in FIG. 5. In order to further secure the glued connection between the shell sole 6 and the shaft 3, a seam 28 is sewn in with a sewing machine 27.

After gluing and also after possible sewing, the shoe may be steamed in a pressure chamber (not shown) wherein the leather will become flexible, more supple, and, therefore, more easily shaped. A last is now inserted for the first time in the steamed shoe. The lasted shoe is dried in a drying apparatus wherein the leather now takes on its final form. The leather will maintain this form after the last is removed. The final manufacturing operations consist of the completion of the finishing and of the placing in and gluing in of a cover sole.

Thus, in accordance with the present invention, it will be seen that several advantages may be achieved. Among the advantages is the fact that approximately 30% of the leather upper material can be spared and that the number of manufacturing operations may be considerably reduced so that the material portion as well as the labor costs of production will be drastically reduced.

In accordance with a further advantageous development of the invention, an additional seam can be provided in order increase the durability of the connection between the sole and the shaft. Of course, this seam can be structured simultaneously in an ornamental fashion.

As previously indicated, in accordance with the invention, after the operation of gluing the shaft and the shell sole together, the shoe can be steamed and this may be accompanied by overpressure and then the shoe may be lasted, dried and the last subsequently removed. Steaming the shoe is recommended in particular with regard to leather shoes which obtain their final form corresponding to the last by means of this concluding process. Since lasts are required only during the final processing step, their quantity can be substantially reduced, thereby resulting in further increase in the efficiency of the manufacturing process.

Moreover, it is possible to glue the cover sole with the shell sole.

As has already been mentioned, the production method in accordance with the present invention may be performed mechanically or automatically to a large extent.

Therefore, in order to carry out the invention, a series of devices are of course necessary which are applied during the individual production steps and which guarantee production of footwear which will be inexpensive and free of faults and of high quality.

The most important part of the apparatus, and, at the same time, that part which brings about the greatest economy, is the apparatus with which the shaft, which is prepared in the tip area so as to conform to the last, is stretched to measure. This apparatus, as previously indicated, comprises the two partial molds 21 and 22, which correspond in contour with the lasts and the shaft is preformed on these partial molds. The tip contact pressure mold 23 presses the preformed shaft in the tip against the front partial mold by means of which the leather is immovably held, but the apparatus operates to leave the glued border of the shaft free. By means of the heel contact pressure mold 24, the heel area of the shaft is pressed and the rear cap is simultaneously pressed and formed. Here also, the glued border of the shaft remains free. Finally, the additional contact pressure molds serve to press the gluing surfaces after the prepared shell sole is placed on the stretched and fixed shaft in order to produce a fault-free gluing connection. The partial molds and the contact pressure molds are capable of being heated.

In accordance with further advantageous features of the invention, the partial molds with which the shaft is stretched, and the contact pressure molds with which the shaft is fixed and with which the gluing surfaces are pressed, may be pneumatically driven. Manual operations will consist merely in placing on of the shaft, placing on of the shell sole and removing of the glued shoe.

While a specific embodiment of the invention has been shown and described in detail to illustrate the application of the inventive principles, it will be understood that the invention may be embodied otherwise without departing from such principles.

What is claimed is:

1. In a method for producing footwear, wherein a leather upper of said footwear devoid of a lasting fold is first cut to size, prepared, sewed to form a shaft and provided with a front cap and a rear cap, said method including the steps of roughening a lower border of said shaft, providing a shell sole and roughening a border of said shell sole, applying adhesive to parts of said shaft and said shell sole to be glued together, placing said shell sole on said shaft and pressing said shell sole at least against the tip and the heel thereof and forming final finishing operations for said footwear to give to said footwear the form of a last, the improvements comprising that after said shaft is sewed only said tip is definitively formed so as to conform to said last, that said shaft is then placed on a last-like two-piece tensioning apparatus, is fixed with contact pressure molds and is axially stretched to size, that said rear cap is simultaneously definitively formed and that said shell sole is glued to the stretched shaft.

2. A method according to claim 1, further comprising the step of additionally sewing said shaft and said shell sole together.

3. A method according to claim 1, wherein after gluing said shaft and said shell sole, said footwear is steamed with overpressure, said footwear being then lasted, dried with the last being then removed.

4. A method according to claim 3, wherein a cover sole is placed in and is glued to said shell sole.

5. Apparatus for producing footwear, wherein said footwear is formed to include a leather upper part without a lasting fold comprising a shaft of said footwear and a sole, said apparatus comprising two partial molds which correspond with a last in contour and upon which said shaft is placed after having formed thereon a tip, a tip contact pressure mold which secures said shaft in the area of said tip but which leaves free a roughened and adhesive containing border of said shaft, a heel contact pressure mold which presses a rear cap of said footwear but which leaves free said border of said shaft, said partial molds and said respective contact pressure molds being adjustable relative to one another in the longitudinal direction of said sole and additional contact pressure molds for pressing against a shell sole border, at least one of said partial molds and said contact pressure molds being heatable.

6. Apparatus according to claim 5, wherein said partial molds and said contact pressure molds are pneumatically driven.

7. A method according to claim 1, wherein a cover sole is placed in and is glued to said shell sole.

* * * * *